US009004051B2

(12) United States Patent
Barber

(10) Patent No.: US 9,004,051 B2
(45) Date of Patent: Apr. 14, 2015

(54) FOLDING TAKE-DOWN FLAT ARCHERY BOW

(71) Applicant: Jeffrey Glen Barber, Guyton, GA (US)

(72) Inventor: Jeffrey Glen Barber, Guyton, GA (US)

( * ) Notice: Subject to any disclaimer, the term of this patent is extended or adjusted under 35 U.S.C. 154(b) by 0 days.

(21) Appl. No.: 13/861,474

(22) Filed: Apr. 12, 2013

(65) Prior Publication Data

US 2015/0059720 A1 Mar. 5, 2015

Related U.S. Application Data

(60) Provisional application No. 61/680,301, filed on Aug. 7, 2012.

(51) Int. Cl.
*F41B 5/10* (2006.01)
*F41B 5/00* (2006.01)
*F41B 5/14* (2006.01)

(52) U.S. Cl.
CPC ..... *F41B 5/0094* (2013.01); *F41B 5/1403* (2013.01)

(58) Field of Classification Search
CPC ..... F41B 5/10; F41B 5/14; F41B 5/00; A63B 2244/04; A63F 9/0252
USPC ..... 124/23.1, 25.6
See application file for complete search history.

(56) References Cited

U.S. PATENT DOCUMENTS 2,001,470 A * 5/1935 Nyvall ..... 124/24.1
4,291,452 A * 9/1981 Whitman et al. ..... 29/235
7,484,505 B1 * 2/2009 Saunders ..... 124/20.1

* cited by examiner

*Primary Examiner* — Melba Bumgarner
*Assistant Examiner* — Amir Klayman
(74) *Attorney, Agent, or Firm* — Jonathan R. Smith; Jonathan Rigdon Smith, P.C.

(57) ABSTRACT

An archery bow is comprised of at least a riser and two limbs that can be folded into a position forming its own case to protect the limbs, or taken down and reassembled with limbs of various draw weights. When taken down it may also be reconfigured to enable use by an archer with opposite handedness. In its folded state it is highly compact and transportable.

13 Claims, 5 Drawing Sheets

FOLDING TAKE-DOWN FLAT ARCHERY BOW

CROSS-REFERENCE TO RELATED APPLICATIONS

This application is a non-provisional of U.S. provisional application Ser. No. 61/680,301 filed Aug. 7, 2012.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The instant invention is in the technical field of archery bows. More particularly, the instant invention is in the technical field of folding and take-down bows.

Conventional folding bows when folded into a stored position, due to the shape of the typical riser and often the shape of the limbs, are bulky, making them somewhat cumbersome to transport. Additionally, the limbs are not protected from possible damage, unless one places the entire bow in a protective case, making the unit less compact and bulkier for transport. Conventional take-down bows when in the take-down mode are in two or more pieces, leaving them subject to damaged limbs or lost parts.

Take-down bows do have the ability to interchange limbs of various tension, or draw weights; however, in order to transport a take-down bow and lessen the risk of lost or damaged parts, one must place them in a carrying case or like device, making the bow a bulkier, heavier item to transport.

Another disadvantage of both the take-down and folding bow is that due to the design of the typical riser, they are manufactured with either a right-handed or left-handed shooter in mind. This makes it difficult for someone to use a bow constructed for a person of opposite handedness.

SUMMARY OF THE INVENTION

The instant invention is a bow that retains the features of a folding bow and a take-down bow, but incorporates the ability to fold the limbs into the riser for transport, thereby creating its own, compact, protective carrying case. In addition, the design also incorporates the ability to remove the limbs, flip them over, then reinstall them, thus transforming the bow into one of opposite handedness.

DETAILED DESCRIPTION OF THE INVENTION

Figure 1:
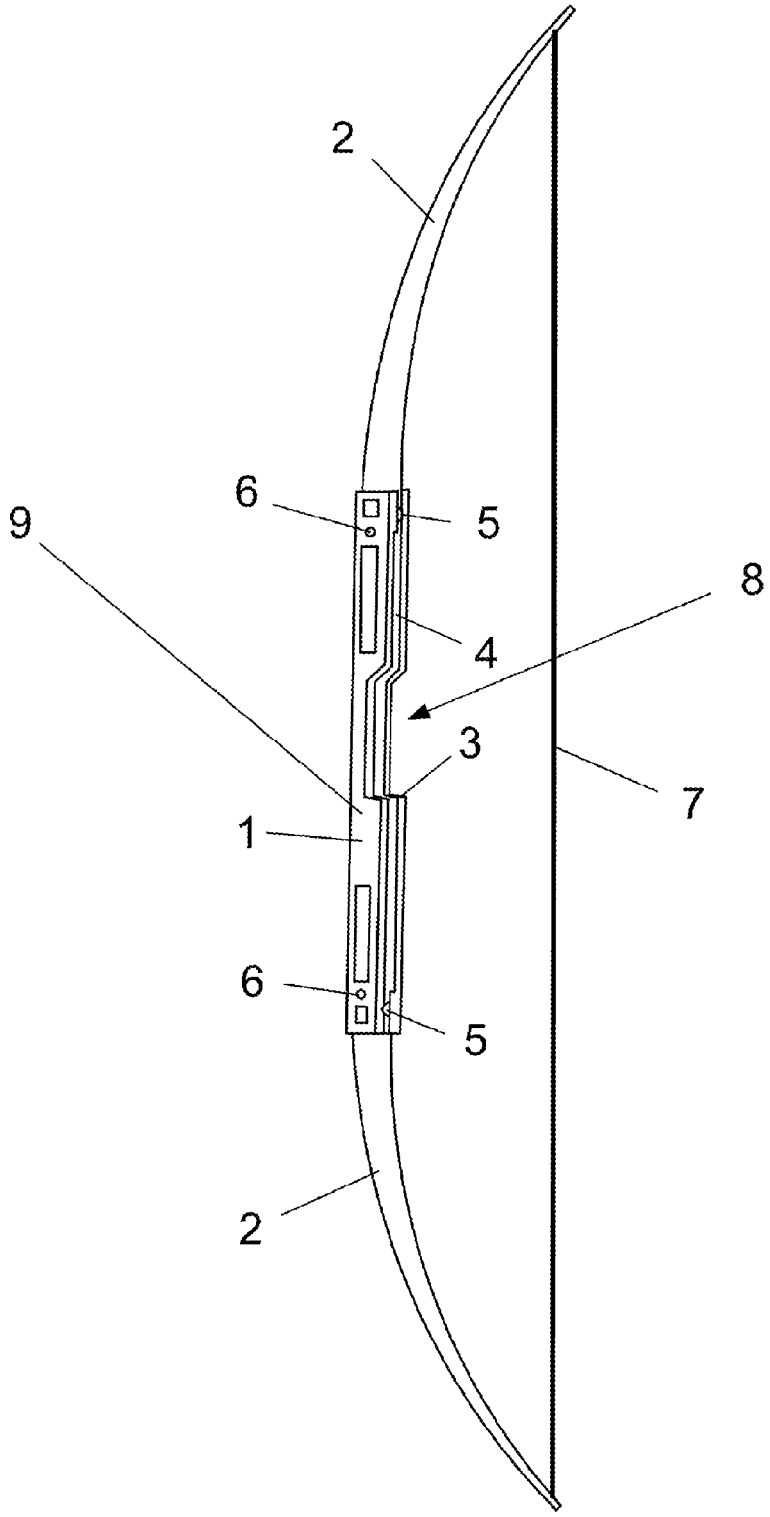
FIG. 1 is a perspective view of a folding take-down flat archery bow of the instant invention in a strung position.
Figure 2:
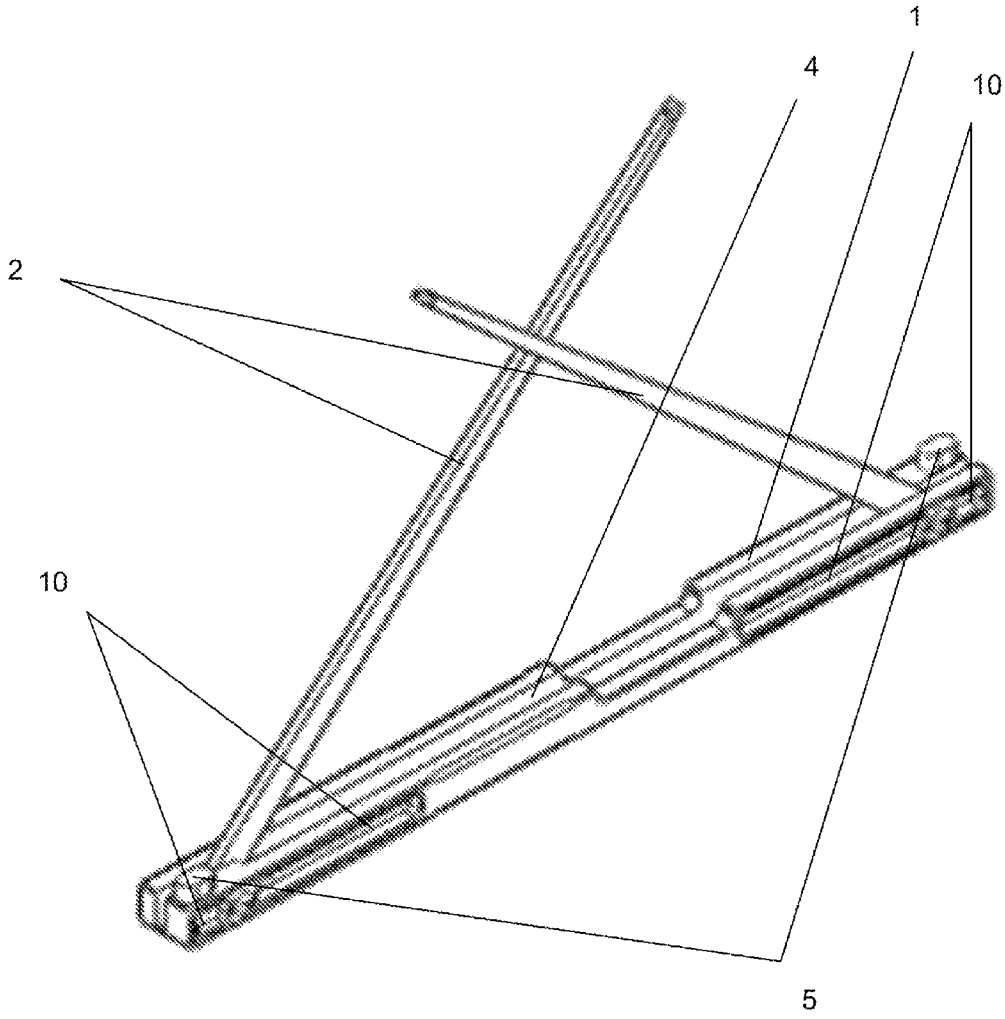
FIG. 2 is a perspective view of the instant invention in the process of being folded for transport or storage.
Figure 3:
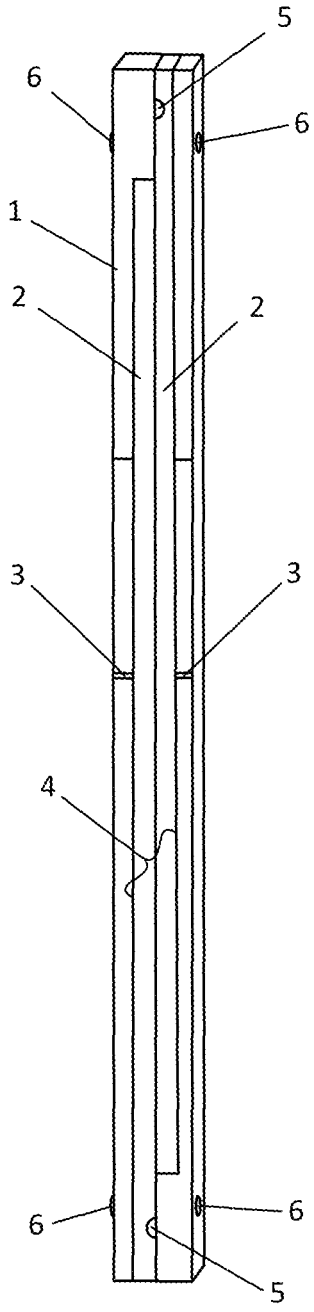
FIG. 3 is a side view of the instant invention in a folded position with the string detached.

Referring now to the invention in more detail, in which like reference numerals refer to like features in each of the several drawings, FIG. 1 is a perspective view of a folding take-down flat archery bow of the instant invention in a strung position. The archery bow has upper and lower limbs 2 connected to opposite ends of a handle called a riser 1 by means of a bolt or pin 6. Pin 6 also acts as a pivot for the limbs 2. In this view, the bow is in an open position with the string 7 attached and the limb locking mechanism 5 holding the limbs 2 in an open position. In FIG. 1 a void 4 in the riser 1 is shown which accommodates the limbs 2 when in a folded position as shown in FIG. 2 and FIG. 3. FIGS. 1 and 3 show an arrow shelf 3 which when cut into the riser 1 allows a place for an arrow to rest upon. The cut may be small enough only to accommodate an arrow, or it may be extended optionally in a vertical direction to create a window 8 which can be used to sight down the arrow for aiming purposes. The arrow shelf need not be cut into the riser but alternatively take the form of an extension to the left as shown in FIG. 1.

The perspective of FIG. 1 shows the window 8 on the left side of this view and the string 7 behind the riser 1. As such, this bow of the instant invention is set up for a right-handed user. The bow is held by the left hand below the shelf 3, with the window facing to the archer's left. The front face of the riser 1 in this view is called the belly 9. The opposite face (facing the string) is called the back. The void 4 faces to the right in this view (the archer's left).

In theory it would be possible to change this to a left-handed bow merely by restringing it so that the limbs 2 are bent toward the viewer. However, most limbs have a permanent set so that their principal curvature is toward the rear in this view. An important feature of the instant invention is therefore that it can be converted to a left-handed bow by unstringing it, detaching the limbs 2 from the riser 1 by unlocking the limb locking mechanisms 5, pulling the pins 6, rotating the riser 1 about its vertical axis 180 degrees, re-inserting the pins 6, and re-locking the limb locking mechanisms 5.

FIG. 2 shows the instant invention in the process of its limbs 2 being folded for storage or transport. The limbs 2 depicted here are drawn as flat, but as explained above, they are often constructed with curvature or acquire it under string tension. This view also shows one form of locking mechanism meant to retain the limbs 2 in either extended or folded position. The locking mechanisms 5 are shown here as obround cams that are turned so that their major axes align with the elongate axis of the riser 1 so as to open the void 4 so that the limbs 5 can be moved from one position to the other. It is apparent in this view that the locking mechanisms 5 would span the void 4 if they were turned 90 degrees from the orientation shown, thereby preventing release of the limbs 2. In this and other drawings, optional cavities 10 are shown in the belly and back faces of the invention, mainly to reduce the amount of material needed to mold the riser 1.

Figure 4:
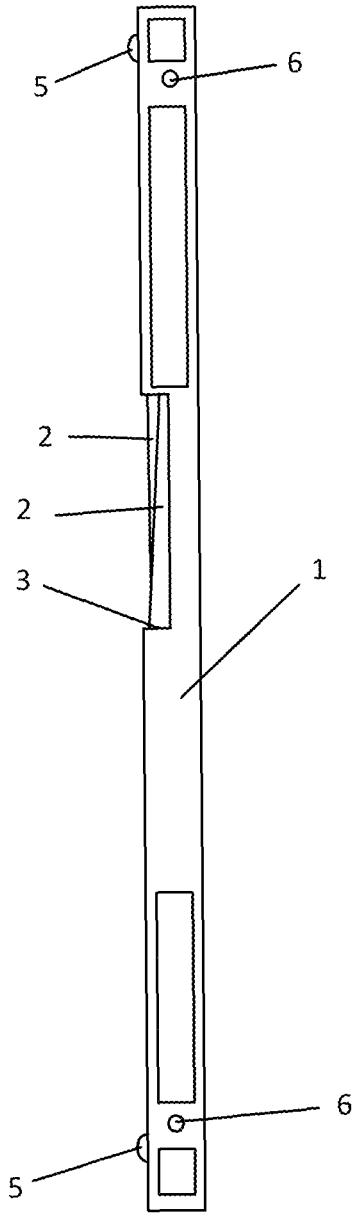
FIG. 4 is a back or belly view of the instant invention in a folded position with the string detached.

Referring specifically to FIG. 3 and FIG. 4, the limbs 2 are also shown as flat, in a folded position within void 4. Even if the limbs 2 are not flat, they will straighten as they are slid into the void 4 because they are resiliently flexible.

Figure 5:
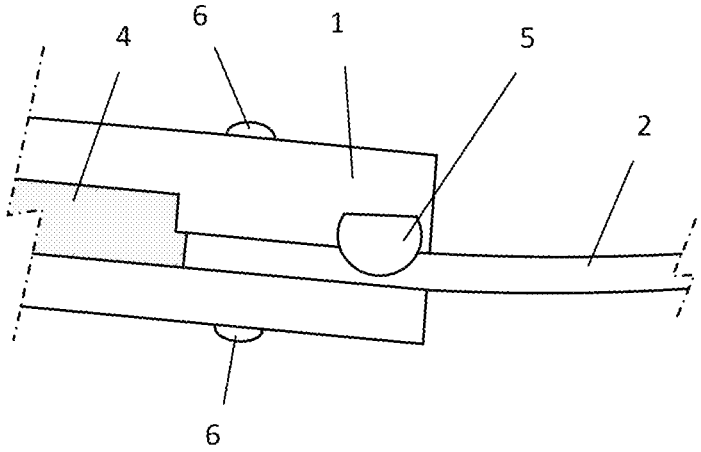
FIG. 5 is a detail view of one end of the riser of the instant invention in an open position.

FIG. 5 is a detail view of one end of the riser 1, meant to show in detail the narrowing of the void 4 in the riser 1 on each end on opposite sides to accommodate only one limb 2. FIG. 5 also gives a closer look at the bolt or pin 6 which retains the limbs 2 and acts as their pivot point. It also shows one limb 2 in an open position with the limb locking mechanism 5 holding the limb 2 in a locked position. This view shows an alternative shape for the locking mechanism 5, in which its shape requires it to be turned 180 degrees to release the limb 2. The scope of this invention includes other means of temporarily locking the limbs 2 relative to the riser 1 not depicted here such as a second through bolt parallel to pivot pin 6.

In more detail to illustrate opening the instant invention from the folded state to make it ready for use, and still referring to the invention of FIGS. 1 through 4, one would move the limb locking mechanism 5 to the open position and move the limbs 2 from the void 4 in the riser 1 as shown in FIG. 1, pivoting the limbs 2 180 degrees on the pin or bolt 6, then locking the limbs 2 in an open position by turning the limb locking mechanisms 5 back to a closed position. A string 7 is then affixed as shown in FIG. 1 and the archery bow is ready for use. To return the bow to a closed position as shown in FIGS. 2 and 3, a user essentially repeats the steps in reverse.

In further detail, still referring to the invention of FIGS. 1 to 5, preferred dimensions are given as follows. The riser 1 is preferably about 23 inches long by about 1⅛ inches wide on the front and back and about 1½ inches thick on the side. The void 4 is in the side of the riser 1 and is about 1 inch deep and ½ inch wide for the length of the riser, except for approximately the last 2 inches on each end of the riser 1 where the void 4 in the riser 1 is about ¼ inch, offset from the opposing ¼ inch void 4 on the opposite end of the riser 1. The limbs 2 are about 20 inches long and one inch wide at the proximal end for the first two inches, tapering for the last 18 inches to ½ inch at the distal end, and have a uniform thickness of ¼ inch. The bolt or pin 6 should be sufficiently long to insert from the front or back of the riser 1, through a properly sized hole in the riser 1 and the limbs 2, and again through the opposite side of the riser 1, to secure the limbs 2 in place and act as a pivot point. The limb locking mechanisms 5 can vary in size and shape as long as they sufficiently lock the limbs 2 in place. The string 7 as shown in FIG. 1 should measure about 53 to 55 inches long.

The preferred materials of construction of the invention as shown in FIG. 1 through FIG. 4 are as follows. The riser 1 may be made of metal or any other material sufficiently rigid and strong material such as hard wood high-strength plastic. The limbs 2 may be made of fiberglass, wood, a lamination of both, or any other material that will provide the desired flexion and resistance. The bolt or pin 6, the limb locking mechanism 5, and the string 7 in FIG. 1 can be made of any materials sufficient to accomplish their tasks.

The advantages of the instant invention, without limitation, are that it is highly compact and portable in its folded position, forming its own carrying case, protecting the limbs and making it easy to transport. It can be disassembled as well to change out the limbs for different draw weight limbs. As mentioned above, a shooter can re-arrange the limbs to suit right- or left-handedness.

In broad embodiment, the instant invention is an archery bow having at least a riser and two limbs.

While the foregoing written description of the invention enables one of ordinary skill to make and use what is considered at the time of its invention to its best mode, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

The invention claimed is:

1. An archery bow, comprising:
an elongate, flexible upper limb;
an elongate, flexible lower limb;
the limbs being pivotable in a common plane, each comprising
a distal end comprising a bow string attachment means; and
a proximal end comprising a first part of a limb pivoting and removal means; a length from the distal end to the proximal end;
an elongate, vertical, rigid riser, comprising
an upper end;
a lower end;
the upper and lower ends each comprising
a second part of a limb pivoting and removal means; and
a limb locking means;
four elongate faces;
a left face;
a right face opposite the left face;
a belly face, between and substantially at right angles to, the left and right faces;
and
a back face opposite the belly face;
the left face comprising
an arrow shelf formed upon a portion of the riser from the belly face through to the back face creating a first notch in the left face partially through to the right face; and
an elongate limb-accommodating void formed within the riser between the upper end through to the lower end creating a second notch in the left face partially through to the right face and extending along the vertical centerline of the left face; the second notch having a length that is at least as long as the length of the limbs and having a width so dimensioned as to slidingly accommodate both limbs side by side when pivoted in the common plane fully into the second notch.

2. The archery bow of claim 1, in which:
said first part of a limb pivoting and removal means comprises
a first hole through said proximal end of said limb;
said second part of a limb pivoting and removal means comprises
a second hole proximate to one of said ends of said riser;
the second hole extending from said belly face to said back face, substantially parallel to said left face and said right face; and
a cylindrical pin removably joining said limb to one of said ends of said riser by passing through the first hole and the second hole.

3. The archery bow of claim 2, in which
said limb locking means comprises a shaped cam rotatably attached to said left face proximate to each of said upper and lower ends;
the shaped cam spanning the limb-accommodating void across said left face to lock the limbs when rotated to a first position and leaving the limb-accommodating void unspanned when rotated to a second position.

4. The archery bow of claim 3, in which:
said cam is shaped to be turned by hand.

5. The archery bow of claim 1, in which:
said first notch is extended vertically above said arrow shelf to form a sight window.

6. The archery bow of claim 4, comprising:
a string having a string length, and in which
said first part and said second part join
said upper limb to said upper end so that said upper limb is rotated about said pin to extend said distal end about 180 degrees away from said lower end, and said cam is rotated to said first position;
said lower limb to said lower end so that said lower limb is rotated about said pin to extend said distal end about 180 degrees away from said upper end, and said cam is rotated to said first position;
the combined length of the joined upper limb, riser, and lower limb being greater than the string length, such that when the string is strung between the bow string attachment means of the upper limb and the bow string attachment means of the lower limb, the limbs bend towards, and define, said back face.

7. The archery bow of claim 4, in which:
said first part and said second part join
said upper limb to said upper end so that said upper limb can be rotated about said pin to fit within said limb-accommodating void; and
said lower limb to said lower end so that said lower limb can be rotated about said pin to fit within said limb-accommodating void.

8. An archery bow, comprising:
an elongate upper limb;
the upper limb being flexible within a first plane;
and comprising
a first outer end;
an upper bow string attachment means proximate to the first outer end;
a first inner end; and
an upper limb pivot hole
proximate to the first inner end; and
an upper limb curvature in the first plane;
an elongate lower limb;
the lower limb being flexible within the first plane;
and comprising
a second outer end;
a lower bow string attachment means proximate to the second outer end;
a second inner end; and
an lower limb pivot hole proximate to the second inner end; and
a lower limb curvature in the first plane;
an elongate, vertical, rigid riser, comprising
an upper end; comprising
an upper end pivot hole having a horizontal axis lying within the first plane and proximate to the upper end; and
an upper end limb locking means proximate to the upper end;
a lower end; comprising
a lower end pivot hole having a horizontal axis lying within the first plane and proximate to the lower end; and
a lower end limb locking means proximate to the lower end;
four elongate faces;
a first face;
a second face opposite the first face;
a third face, between and substantially at right angles to, the first and second faces; and
a fourth face opposite the third face;
the first face comprising
an arrow shelf formed upon a portion of the riser from the third face through to the fourth face creating a first notch in the first face partially through to the second face; and
an elongate vertical limb-accommodating void formed within the riser creating a second notch in the first face partially through to the second face; the second notch having a length and width so dimensioned as to slidingly accommodate both limbs side by side when the limbs are pivoted about the upper and lower end pivot hole axes into the second notch;
an upper pin rotatably and removably attaching the first inner end within the second notch by passing through the upper end pivot hole and the upper limb pivot hole, so that
the first plane is perpendicular to the third face;
the upper limb extends upwardly from the upper end;
the upper end limb locking means is locked; and
the upper limb curvature is convex towards the third face;
a lower pin rotatably and removably attaching the second inner end within the second notch by passing through the lower end pivot hole and the lower limb pivot hole, so that
the first plane is perpendicular to the third face;
the lower limb extends downwardly from the lower end;
the lower end limb locking means is locked;
the lower limb curvature is convex towards the third face; and
a bow string attached between the upper bow string attachment means and the lower bow string attachment means.

9. The archery bow of claim 8, in which
said limb locking means comprises a shaped cam rotatably attached to said left face proximate to each of said upper and lower ends;
the shaped cam spanning the limb-accommodating void across said left face to lock the limbs when rotated to a first position and leaving the limb-accommodating void unspanned when rotated to a second position.

10. The archery bow of claim 9, in which:
said cam is shaped to be turned by hand.

11. The archery bow of claim 8, in which:
said first notch is extended vertically above said arrow shelf to form a sight window.

12. A method for folding and storing the archery bow of claim 8, comprising the steps of:
(a) unlocking the upper and lower limb locking means;
(b) removing the bow string from the upper and lower bow string attachment means;
(c) rotating the upper limb about the upper pin, rotating the lower limb about the lower pin, and fitting the limbs into the limb accommodating void; and
(d) locking the upper and lower limb locking means.

13. A method for changing the handedness of the archery bow of claim 8, comprising the steps of:
(a) unlocking the upper and lower limb locking means;
(b) removing the upper and lower pins from the upper and lower pivot holes, respectively;
(c) removing the first and second inner ends from the limb accommodating void;
(d) revolving the riser about its elongate axis 180 degrees;
(e) re-inserting the first inner end and the second inner end into the limb accommodating void, aligning the upper and lower limb pivot holes with the upper and lower end pivot holes, respectively;
(f) re-inserting the upper and lower pins into the upper and lower pivot holes, respectively; and
(g) re-locking the upper and lower limb locking means.

* * * * *